US012064672B1

(12) United States Patent
Wagner

(10) Patent No.: US 12,064,672 B1
(45) Date of Patent: Aug. 20, 2024

(54) GOLF TEE INSERTER

(71) Applicant: Ridge Golf LLC, Poynette, WI (US)

(72) Inventor: Blake H. Wagner, Poynette, WI (US)

(73) Assignee: Ridge Golf LLD, Poynette, WI (US)

( * ) Notice: Subject to any disclaimer, the term of this patent is extended or adjusted under 35 U.S.C. 154(b) by 0 days.

(21) Appl. No.: 18/215,920

(22) Filed: Jun. 29, 2023

(51) Int. Cl.
*A63B 57/00* (2015.01)

(52) U.S. Cl.
CPC ..... *A63B 57/0037* (2013.01)

(58) Field of Classification Search
CPC .... A63B 57/0037; A63B 57/10; A63B 57/203
See application file for complete search history.

(56) References Cited

U.S. PATENT DOCUMENTS 3,074,719 A * 1/1963 McKee ..... A63B 57/0037 227/142
3,333,848 A * 8/1967 Budzinski ..... A63B 57/0037 294/16
3,671,037 A * 6/1972 Murdock, Jr. ..... A63B 57/0037 473/386
4,660,837 A * 4/1987 Bressie ..... A63B 57/0037 473/386
5,370,388 A * 12/1994 Wehner ..... A63B 57/0037 473/386
5,643,113 A * 7/1997 Rodgers ..... A63B 57/0037 473/282
D386,992 S 12/1997 Burnett et al.
6,338,685 B1 1/2002 Posluszny
6,949,033 B1 * 9/2005 Mydland ..... A63B 57/0037 473/386
7,223,184 B2 5/2007 Suwito
9,539,480 B1 1/2017 Boswell
D937,958 S 12/2021 Marino
2005/0049085 A1 * 3/2005 Cumisky ..... A63B 57/207 473/386
2008/0305892 A1 12/2008 Aulepp, Jr.

OTHER PUBLICATIONS

"T-LevL", downloaded Mar. 13, 2023, https://tlevl.com.
"Golf Tee/Height Adjustable, Golf Tee, Golf Accessories", U1-Golf Tee, downloaded Mar. 13, 2023, https://www.amazon.com/Golf-Tee-Height-Adjustable-Accessories/dp/B09FXRLTDZ.
"Golf Tee Setter", downloaded Mar. 13, 2023, https://www.amazon.com/Golf-Tee-Setter-LYSB01N762CD4-SPRTSEQIP/dp/B01N762CD4/ref=cm_cr_arp_d_product_top?ie=UTF8.
"Perfect Tee Setter", Kickstarter, downloaded Mar. 13, 2023, https://www.kickstarter.com/projects/123teesetter/perfect-tee-settersets-your-golf-tee-at-a-perfect-height/?ref=kicktraq.

* cited by examiner

*Primary Examiner* — Steven B Wong
(74) *Attorney, Agent, or Firm* — Stiennon & Stiennon

(57) ABSTRACT

A device for inserting a golf tee in the ground at a determined height has a housing with a tubular interior shaft, and having two opposed side slots. Locking strips with parallel teeth on opposites sides of slots are fixed within the housing. A pusher assembly has flexible pivot arms with locking teeth which face outwardly towards the locking strip teeth such that in an undeflected configuration, the pivot arm teeth engage with the locking strip to fix the pusher assembly at a selected height. Release buttons on the arms are engaged through the locking strip and housing slots for adjusting the height of the pusher. The housing has a base with a downwardly facing opening through which a golf tee is inserted to engage the pusher assembly. With the pusher assembly set at a calibrated height, the tee is insertable by urging the entire assembly against the ground.

17 Claims, 3 Drawing Sheets

GOLF TEE INSERTER

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to devices for positioning golf tees at a desired elevation in the ground.

In the early days of the game of golf, the golf ball was disposed on a small mound of sand which the golfer formed by hand to the desired height. The golf tee of William Lowell, shown in U.S. Pat. No. 1,670,627, the disclosure of which is incorporated by reference herein, had a cup-like head which supported the ball on a pointed wooden shank which was inserted in the ground. The golf tee provided a convenient low-cost article which allowed the golfer to choose the desired elevation of the ball by pressing the shank into the ground a greater or lesser extent.

Depending on the type of golf club selected for a particular shot, the golfer seeks to obtain a different elevation of the ball on the tee. For example, when using irons, the ball will be closer to the ground, and when using drivers, the ball will be more elevated. The golfer seeking repeatability in all the factors influencing the travel of the ball can employ a calibrated tee inserter device which provides marked indicators of the degree of tee insertion. What is needed is a golf inserter device which is not only repeatable and accurate, but also simple to use and readily manufactured and assembled.

SUMMARY OF THE INVENTION

A golf tee inserter has an extruded aluminum housing with a ground engaging base at a lower end around an opening for receiving a golf tee. The housing has a tubular interior shaft and opposed side slots which extend upwardly from the base. Plastic locking strips fixed within the housing, having vertical slots aligned with the housing slots. Each locking strip has a plurality of parallel inwardly facing teeth. A pusher assembly has a guide member which travels vertically within rails formed on the interior shaft and which is snapped to an engagement member with a surface which faces downwardly to engage the golf tee. The pusher assembly has two opposed flexible pivot arms, each of which has inner locking teeth which face outwardly towards the outer teeth adjacent the first side slot and the second side slot. Release buttons are formed on each flexible pivot arm which extend through the housing side slots. The tee engaging surface of the engagement member of the pusher assembly is arranged to engage the head of a golf tee inserted within the lower opening at the base of the housing. A scale is etched or printed on the housing between the slots, enabling a user to determine the desired depth of insertion for an inserted tee. By depressing the pusher assembly release buttons, the flexible pivot arms are pivoted inwardly to release the flexible arm inner locking teeth from engagement with the locking strip teeth thereby allowing vertical displacement of the pusher assembly within the tubular interior shaft to position the pusher assembly at a desired vertical location, setting the amount of tee insertion that will be obtained when the device pressed downwardly until the housing base engages the surface of the ground.

It is an object of the present invention to provide a device which enables a golfer to insert a golf tee to a calibrated depth in the ground.

It is a further object of the invention to provide a golf tee inserter which can be assembled within screws or independent fasteners.

It is an additional object of the present invention to provide a golf tee inserter with a readily vertically adjustable inserting surface which is secured fixable at a desired height.

Further objects, features and advantages of the invention will be apparent from the following detailed description when taken in conjunction with the accompanying drawings.

DESCRIPTION OF THE PREFERRED EMBODIMENTS

Figure 1:
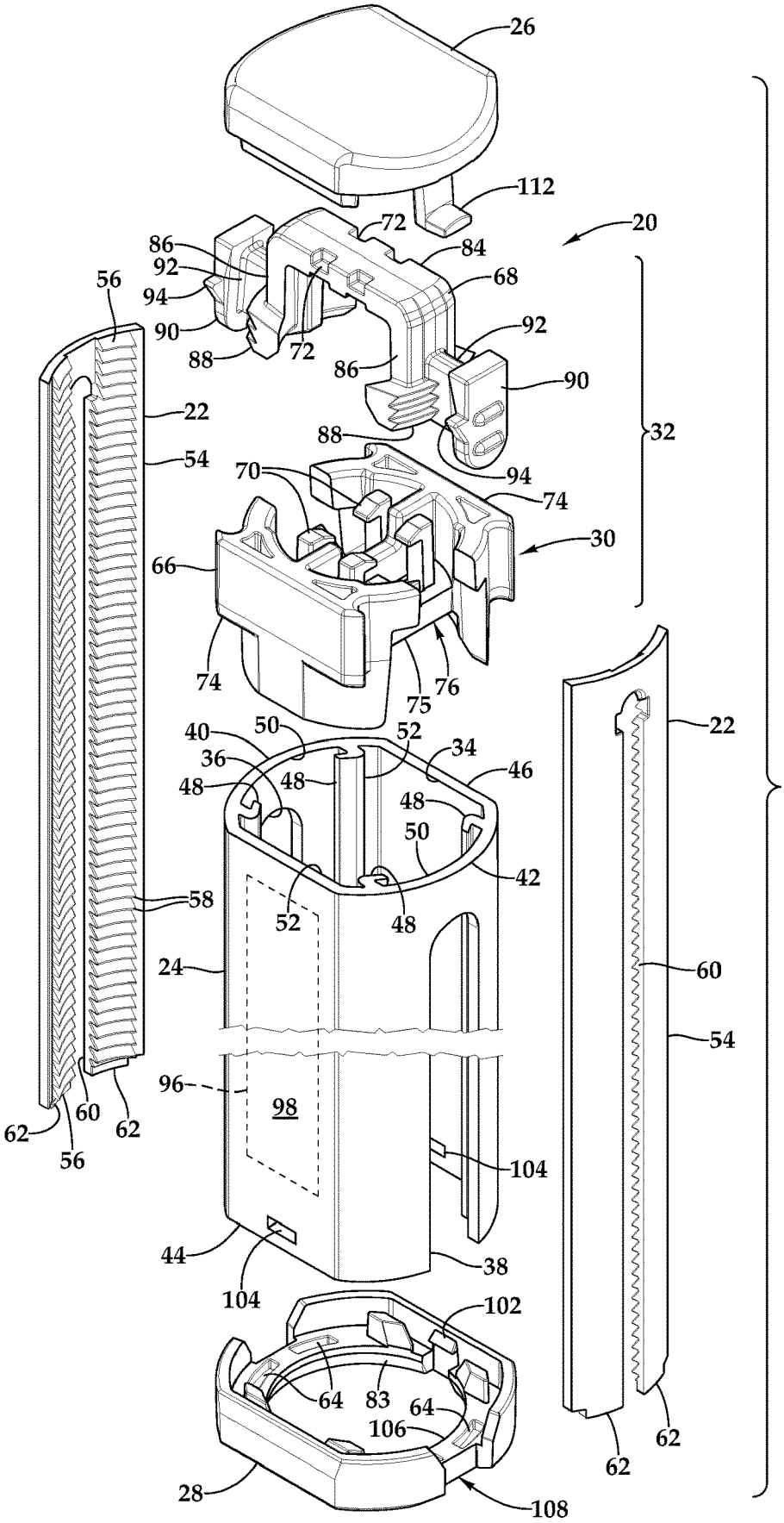
FIG. 1 is an exploded isometric view of the golf tee inserter of this invention.

Referring more particularly to FIGS. 1-4, wherein like numbers refer to similar parts, a golf tee inserter 20 has seven parts, shown in FIG. 1, which are assembled without independent screws or fasteners. Plastic locking strips 22 are positioned within a tubular element 24 which together with a cap 26 and a base 28 define a housing 30 which receives a vertically adjustable pusher assembly 32. The plastic parts may be made of polycarbonate/acrylonitrile butadiene styrene (PC-ABS) or Delrin® acetal homopolymer from DuPont.

Figure 3:
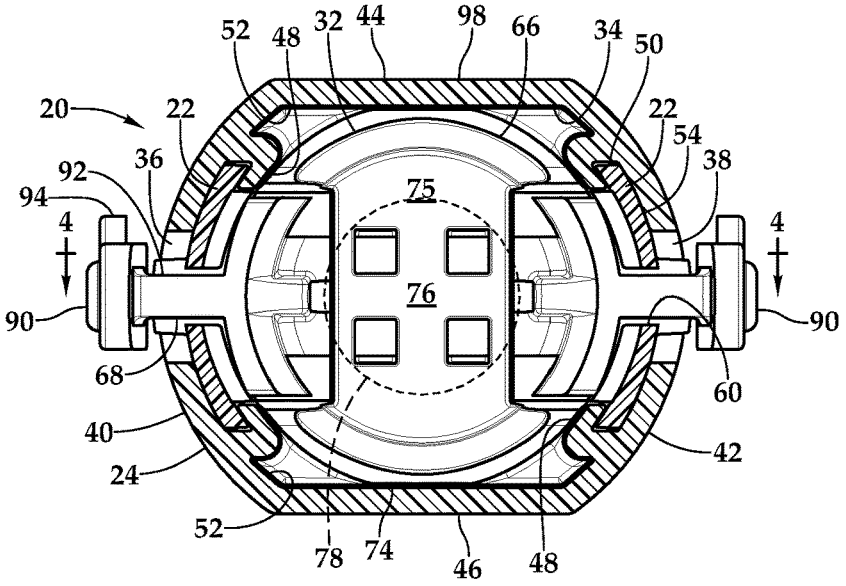
FIG. 3 is a cross-sectional view of the golf tee inserter of FIG. 2, taken along section line 3-3.

The tubular element 24 may be a machined extruded aluminum part. It has a central tubular interior shaft 34 which extends from an upper end adjacent the cap 26 to a lower end adjacent the base 28. The tubular element 24 has a vertically extending first side slot 36 and a second side slot 38 opposite the first side slot. The first side slot 36 is formed within a curved first wall 40 of the tubular element, and the second side slot 38 is formed within a curved second wall 42. The curved walls 40, 42 are connected by parallel third wall 44 and fourth wall 46. The curved walls allow the device to be comfortably retained within a user's pocket. A pair of vertically extending flanges 48 are positioned on each curved wall 40, 42. The flanges 48 in each pair extend towards one another to define a strip channel 50 which receives one of the locking strips 22. The third wall 44 and fourth wall 46 may be substantially planar, as shown in FIG. 3, and guide channels 52 are defined between a vertical flange 48 on each of the first and second curved walls 40, 42 and the respective flat third or fourth wall 44, 46. The guide channels 52 are positioned to guide the vertical travel of the pusher assembly 32.

As shown in FIG. 1, each locking strip 22 may be a molded plastic part which has a thin strip wall 54 which is generally a segment of a cylinder. The locking strips 22 are thus inwardly concave about a vertical axis. Two racks 56 of curved parallel teeth 58 are formed on the interior of the strip wall 54. The teeth are also curved about the vertical axis. A strip slot 60 extends through the locking strip 22 and is positioned between the two racks 56. The strip wall 54 is terminated at its lower end by two stub-like feet 62 which protrude below the teeth and which are received in mating upwardly opening cavities 64 in the base 28. Each locking strip 22 is fixed within the tubular interior 34 with portions of the strip wall 54 engaged between the flanges 48 and the respective curved wall 40, 42 so the strip wall is received within one of the strip channels 50, as shown in FIG. 3. The slots 60 of each locking strip 22 is thus positioned to overlie and extend along the first side slot 36 and the second side slot 38 respectively of the tubular element 24.

As shown in FIG. 1, the pusher assembly 32 is assembled from two molded plastic parts: a guide member 66 which cooperates with the tubular element 24 to restrain the pusher assembly for axial movement within the interior shaft 34, and an engagement member 68 which has structure to releasably interact with the locking strips 22 to fix the pusher assembly 32 at a desired vertical position. The guide member 66 and the engagement member have mating tabs 70 and depressions 72 which allow the parts of the pusher assembly 32 to be secured together in a snap fit.

The guide member 66 has two opposed slide members 74. As shown in FIG. 3, the slide members 74 extend within the guide channels 52 and work to restrict twisting of the pusher assembly 32 as its vertical position is adjusted within the shaft 34. The third wall 44 and fourth wall 46 serve as rails which direct the travel of the slide members 74. The pusher assembly 32 guide member 66 has a lower platform 75 with a downwardly facing tee-engaging surface 76 which is arranged to engage a head 78 of a golf tee 80 which has been inserted within the device 20 through the downwardly facing opening 82 of the base 28.

Figure 2:
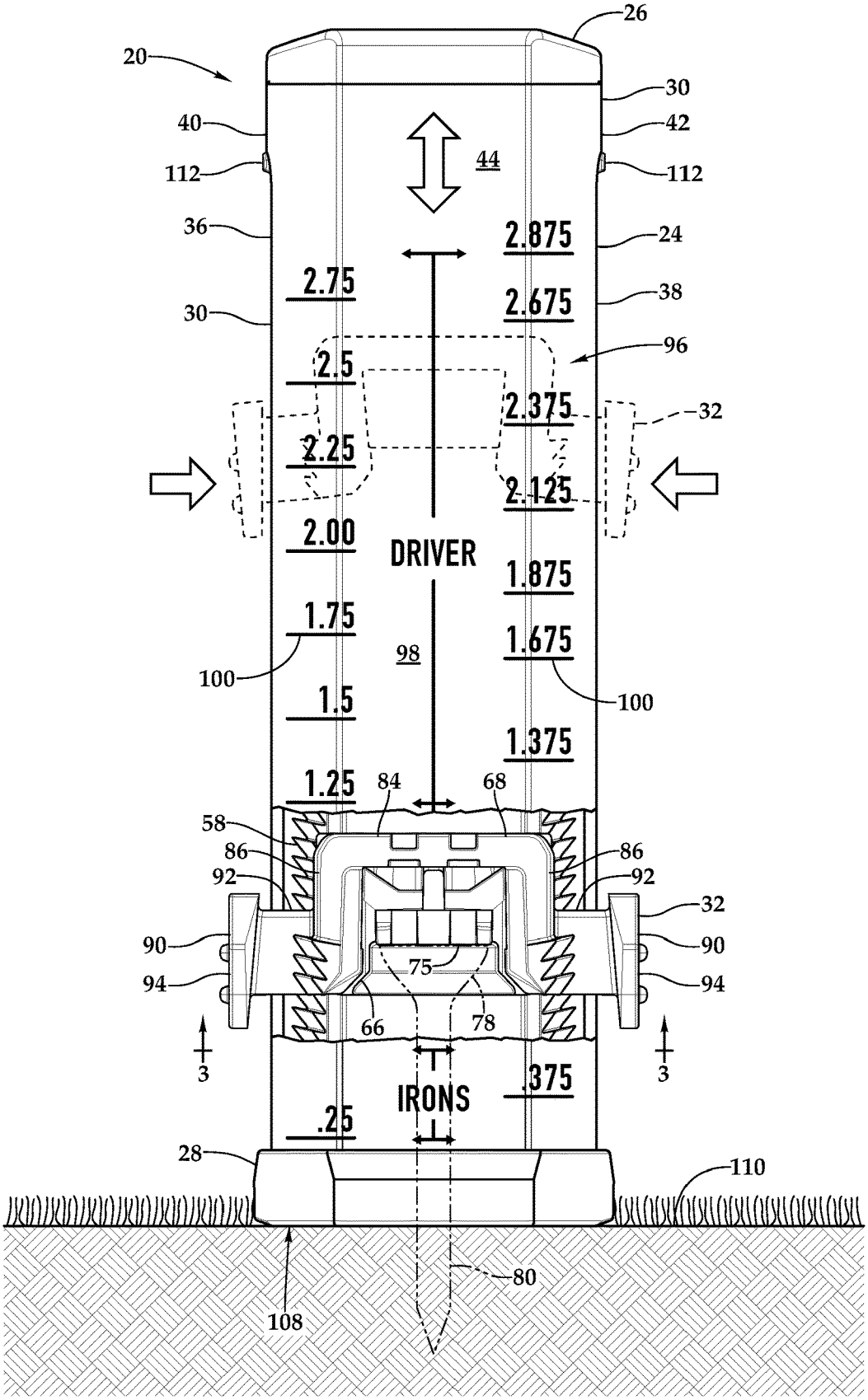
FIG. 2 is a side elevational view of the golf tee inserter of FIG. 1, partially broken away in section, and showing an alternate released position of the pusher assembly.
Figure 4:
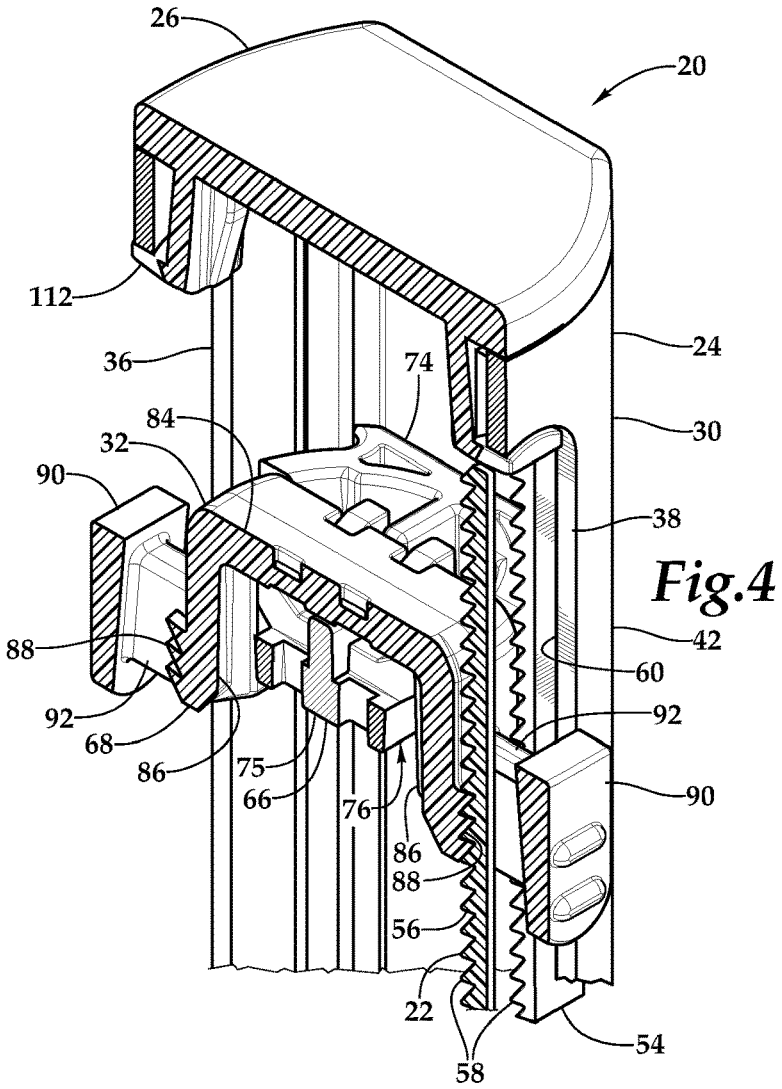
FIG. 4 is a fragmentary isometric section view of the golf tee inserter of FIG. 1 taken along section line 4-4, with the left locking strip omitted.

As shown in FIG. 1, the engagement member a top beam 84 which connects two flexible pivot arms 86 which extend downwardly from the top beam and which are terminated by outwardly facing strips of parallel locking teeth 88. The locking teeth 88 are curved to present convex teeth which in an undeflected configuration engage with the teeth 58 on the adjacent locking strips 22 as shown in FIG. 4. When the pivot arm locking teeth 88 engage the locking strips 22, the pusher assembly 32 is fixed at a selected vertical location within the housing 30. The locking teeth 88 on each pivot arm 86 are positioned on both sides of a sidewardly extending segment 92 which terminates in a release button 90. Each sidewardly extending segment 92 extends through the slot 60 on the locking strip and the slot 36, 38 in the tubular element 24 of the housing 30 to position the release button to be accessible from the exterior of the housing. As shown in broken lines FIG. 2, when a user depresses the release buttons 90, the flexible pivot arms are caused to pivot inwardly, thereby releasing the locking teeth 88 of the two flexible pivot arms 86 from engagement with the parallel teeth 58 of the locking strips 22 and allowing vertical displacement of the pusher assembly 32 within the tubular interior shaft 34 of the housing and repositioning of the pusher assembly at a different vertical location to thereby adjust the location of the downwardly facing tee-engaging surface 76 with respect to the base 28. As shown in FIG. 1, each release button 90 has an arrow-like indicator 94 which may be a mark or a molded-protrusion as shown. The indicators 94 are positioned to indicate the vertical position of the tee-engaging surface 76 by pointing to a calibrated gauge 96 on the exterior surface 98 of the third wall 44 of the tubular element 24 of the housing. As shown in FIG. 2, the gauge 96 is comprised of a plurality of vertically spaced indicia 100, such as horizontal lines with associated depth markings. The release button indicators point towards the vertically spaced indicia to indicate to a user the position of the tee-engaging surface of the pusher assembly and hence the extent to which an inserted golf tee will be inserted into adjoining ground 110 when the housing base is disposed against the ground. The indicia 100 may also include words suggested optimal depths for different types of golf clubs, for example with irons call for the least amount of insertion, drivers the most and woods (not shown) an intermediate amount. Because both indicators 94 are at the same height, the depth-indicating indicia numbers may alternate being on the left of the right of the surface 98 of the third wall, enabling larger and more readable numbers to be used. The indicia may be pad printed, engraved or otherwise formed on the surface 98.

As shown in FIG. 1, the base 28 may be a molded plastic part which snaps into place beneath the tubular element 24 having resilient tabs 102 which snap into place within horizontal slots 104 in the third and fourth walls 44, 46 of the tubular element. The base 28 has an upwardly facing rim wall 106 in which the cavities 64 are formed which receive the feet 62 of the locking strips 22. As shown in FIG. 2, the base 28 has a lower surface 108 which engages the surface of the ground 110 of the golf course when the device 20 is used.

As shown in FIG. 4, the housing 30 is closed at its upper end by the cap 26, which is a molded plastic part with tabs 112 which extend downwardly and protrude outwardly through the first side slot 36 and the second side slot 38 in the tubular element 24 to secure the cap to the tubular element with a snap fit.

When the user is ready to place a golf tee 80, the tee is inserted in the ground, and the buttons are depressed to allow adjustment of the pusher assembly to the desired height. The device 20 is then disposed over the golf tee in the ground until the head 78 of the golf tee 80 contacts the surface 76 of the guide member lower platform 75. The user then presses down on the device 20 to drive the tee into the ground 110. The user presses until the device has bottomed out on the ground. The user then lifts the device off the tee and it is ready for ball placement.

The device 20 can also be used as a club rest for keeping a club handle off the wet grass when the user brings a putter and pitching wedge out at the same time. The cap 26, as shown in FIG. 1, is formed with a concave upper surface which saddles the club handle when the device 20 is positioned upright on the ground.

It is understood that the invention is not limited to the particular construction and arrangement of parts herein illustrated and described, but embraces all such modified forms thereof as come within the scope of the following claims.

I claim:

1. A golf tee inserter comprising:

a housing having a base for engaging a ground surface and having a tubular interior shaft, wherein the housing extends from an upper end to a lower end at the base, and wherein the housing has portions defining a first side slot which extends upwardly and a second side slot opposite the first side slot and which extends upwardly;

a first locking strip and a second locking strip, each having a plurality of parallel teeth and an upwardly extending slot, wherein the first locking strip and the second locking strip are fixed within the tubular interior shaft of the housing alongside the first side slot and the second side slot respectively;

a pusher assembly positioned within the tubular interior shaft of the housing, the pusher assembly having two flexible pivot arms, the flexible pivot arms having locking teeth which face outwardly towards the parallel teeth of the first locking strip and the second locking strip such that in an undeflected configuration, the locking teeth of each flexible pivot arm engage with the teeth of one of the first locking strip and the second locking strip to thereby fix the pusher assembly at a selected vertical location within the housing;

a release button connected to each of the two opposed flexible pivot arms, each release button extending through one of the upwardly extending slots of the first locking strip and the second locking strip and accessible from an exterior of the housing;

portions of the base of the housing which define a downwardly facing opening for the receipt therethrough of a golf tee; and portions of an underside of the pusher assembly which define a downwardly facing tee-engaging surface within the tubular interior shaft of the housing, the tee-engaging surface being arranged to engage a head of a golf tee inserted within the downwardly facing opening of the base of the housing, wherein the depression of the release buttons of the pusher assembly causes the two flexible pivot arms to pivot inwardly thereby releasing the locking teeth of the two flexible arms from engagement with the parallel teeth of the first locking strip and the second locking strip allowing vertical displacement of the pusher assembly within the tubular interior shaft of the housing and repositioning the pusher assembly at a different vertical location to thereby adjust the location of the downwardly facing tee-engaging surface with respect to the base of the housing.

2. The golf tee inserter of claim 1 further comprising a cap overlying the pusher assembly and fixed to the housing to close an upper end of the housing.

3. The golf tee inserter of claim 1 further comprising two vertically extending flanges formed in one side of the housing, the flanges facing one another to define a vertically extending channel which receives the first locking strip therein.

4. The golf tee inserter of claim 1 wherein the pusher assembly is comprised of:

an engagement member which has portions defining the two flexible pivot arms and the release buttons; and a guide member which has portions defining the downwardly facing tee engaging surface, wherein the guide member is secured to the engagement member in a snap fit.

5. The golf tee inserter of claim 1 further comprising:

portions of the housing which define rails which extend vertically within the tubular interior shaft of the housing; and portions of the pusher assembly comprising slide members which engage the rails, such that the slide members remain engaged with the rails when the release buttons of the pusher assembly are depressed causing the two flexible pivot arms to pivot inwardly and guiding the pusher assembly for vertical movement when its position is adjusted vertically within the housing.

6. The golf tee inserter of claim 1 wherein the first side slot is located within a first side wall of the housing and the second side slot is located within a second side wall of the housing, and wherein the housing has a third side wall positioned between the first side wall and the second side wall and further comprising a plurality of vertically spaced indicia positioned on the third side wall, and wherein the release buttons have indicators which point towards the vertically spaced indicia to indicate to a user the position of the tee-engaging surface of the pusher assembly and hence the extent to which an inserted golf tee will be inserted into adjoining ground when the housing base is disposed against the ground.

7. The golf tee inserter of claim 1 wherein the housing comprises a tubular element and the base of the housing comprises a separate element which has an upwardly facing rim wall with depressions formed therein which receive downwardly extending feet formed on the first locking strip and the second locking strip, and wherein the base has protrusions which engage with openings in the tubular element to connect the base to the tubular element in a snap fit.

8. The golf tee inserter of claim 1 wherein the first locking strip is inwardly concave about a vertical axis, and wherein the plurality of parallel teeth of the first locking strip are curved about the vertical axis, and wherein the locking teeth of the flexible pivot arm which are engageable with the parallel teeth of the first locking strip are convex where they engage the plurality of parallel teeth of the first locking strip.

9. A golf tee inserter comprising:

a housing having a base for engaging a ground surface and having a tubular interior shaft, the housing extending from an upper end to a lower end at the base, and wherein the housing has portions defining a first side slot which extends upwardly and a second side slot opposite the first side slot and which extends upwardly, wherein a plurality of inwardly extending parallel outer teeth are disposed within the tubular interior shaft adjacent each of the first side slot and the second side slot;

a pusher assembly positioned within the tubular interior shaft of the housing, the pusher assembly having two opposed flexible pivot arms, the flexible pivot arms having inner locking teeth which face outwardly towards the outer teeth adjacent the first side slot and the second side slot;

a release button connected to each of the two opposed flexible pivot arms, each release button extending through one of the first side slot and the second side slot of the housing;

portions of the base of the housing which define a downwardly facing opening for the receipt therethrough of a golf tee; and portions of an underside of the pusher assembly which define a downwardly facing tee-engaging surface within the tubular interior shaft of the housing, the tee-engaging surface being arranged to engage a head of a golf tee inserted within the downwardly facing opening of the base of the housing, wherein the depression of the release buttons of the pusher assembly causes the two flexible pivot arms to pivot inwardly thereby releasing the inner locking teeth of the two flexible arms from engagement with the outer teeth allowing vertical displacement of the pusher assembly within the tubular interior shaft of the housing and repositioning the pusher assembly at a different vertical location to thereby adjust the location of the downwardly facing tee engaging surface with respect to the base of the housing.

10. The golf tee inserter of claim 9 further comprising a cap overlying the pusher assembly and fixed to the housing to close an upper end of the housing.

11. The golf tee inserter of claim 9 wherein the pusher assembly is comprised of:

an engagement member which has portions defining the two flexible pivot arms and the release buttons; and a guide member which has portions defining the downwardly facing tee engaging surface, wherein the guide member is secured to the engagement member in a snap fit.

12. The golf tee inserter of claim 9 further comprising:

portions of the housing which define rails which extend vertically within the tubular interior shaft of the housing; and portions of the pusher assembly comprising slide members which engage the rails, such that the slide members remain engaged with the rails when the release buttons of the pusher assembly are depressed causing the two flexible pivot arms to pivot inwardly and guiding the pusher assembly for vertical movement when its position is adjusted vertically within the housing.

13. The golf tee inserter of claim 9 wherein the first side slot is located within a first side wall of the housing and the second side slot is located within a second side wall of the housing, and wherein the housing has a third side wall positioned between the first side wall and the second side wall and further comprising a plurality of vertically spaced indicia positioned on the third side wall, and wherein the release buttons have indicators which point towards the vertically spaced indicia to indicate to a user the position of the tee-engaging surface of the pusher assembly and hence the extent to which an inserted golf tee will be inserted into adjoining ground when the housing base is disposed against the ground.

14. The golf tee inserter of claim 9 wherein the plurality of inwardly extending parallel outer teeth include outer teeth positioned on two sides of the first slot; and wherein the inner locking teeth are positioned on the flexible pivot arms on both sides of each of the release buttons.

15. A golf tee inserter comprising:

a housing having a base for engaging a ground surface and having a tubular interior shaft, the housing extending from an upper end to a lower end at the base, and wherein the housing has portions defining a first side slot which extends upwardly and a second side slot opposite the first side slot and which extends upwardly, wherein a plurality of inwardly extending parallel outer teeth are disposed within the tubular interior shaft adjacent each of the first side slot and the second side slot;

a pusher assembly positioned within the tubular interior shaft of the housing, the pusher assembly having two opposed flexible pivot arms, the flexible pivot arms having teeth positioned to engage the outer teeth in a first fixed position;

button portions connected to the opposed flexible pivot arms which extend through one of the first side slot and the second side slot of the housing;

portions of the base of the housing which define a downwardly facing opening for the receipt therethrough of a golf tee; and portions of an underside of the pusher assembly which define a downwardly facing tee-engaging surface within the tubular interior shaft of the housing, the tee engaging surface being arranged to engage a head of a golf tee inserted within the downwardly facing opening of the base of the housing, wherein the depression of the button portions of the pusher assembly causes the two flexible pivot arms to pivot inwardly thereby releasing the pusher teeth from engagement with the outer teeth, placing the pusher assembly into a second movable configuration allowing vertical displacement of the pusher assembly within the tubular interior shaft of the housing and repositioning the pusher assembly at a different vertical location to thereby adjust the location of the downwardly facing tee engaging surface with respect to the base of the housing.

16. The golf tee inserter of claim 15 wherein the pusher assembly is comprised of:

an engagement member which has portions defining the two flexible pivot arms and the button portions; and a guide member which has portions defining the downwardly facing tee engaging surface, wherein the guide member is secured to the engagement member in a snap fit.

17. The golf tee inserter of claim 15 further comprising:

portions of the housing which define rails which extend vertically within the tubular interior shaft of the housing; and portions of the pusher assembly comprising slide members which engage the rails, such that the slide members remain engaged with the rails when the button portions of the pusher assembly are depressed causing the two flexible pivot arms to pivot inwardly and guiding the pusher assembly for vertical movement when its position is adjusted vertically within the housing.

* * * * *